US009953628B1

(12) United States Patent
Lin

(10) Patent No.: US 9,953,628 B1
(45) Date of Patent: Apr. 24, 2018

(54) MICROPHONE DEVICE

(71) Applicant: Merry Electronics (Shenzhen) Co., Ltd., Guangdong (CN)

(72) Inventor: Chia-Chung Lin, Taichung (TW)

(73) Assignee: Merry Electronics (Shenzhen) Co., Ltd., Guangdong (CN)

( * ) Notice: Subject to any disclaimer, the term of this patent is extended or adjusted under 35 U.S.C. 154(b) by 0 days.

(21) Appl. No.: 15/475,156

(22) Filed: Mar. 31, 2017

(30) Foreign Application Priority Data

Oct. 24, 2016 (TW) ..... 105134222 A

(51) Int. Cl.

| | |
|---|---|
| ***G10K 11/178*** | (2006.01) |
| ***H04R 1/40*** | (2006.01) |
| ***H04R 1/08*** | (2006.01) |
| ***H04R 3/00*** | (2006.01) |
| ***H04R 29/00*** | (2006.01) |

(52) U.S. Cl.
CPC ..... *G10K 11/1788* (2013.01); *H04R 1/083* (2013.01); *H04R 1/406* (2013.01); *H04R 3/005* (2013.01); *H04R 29/006* (2013.01); *G10K 2210/3044* (2013.01)

(58) Field of Classification Search
CPC ..... H04R 1/406; H04R 2410/05; H04R 2410/01; H04R 25/552; H04R 29/004; H04R 29/005; H04R 1/326; H04R 2430/25; H04R 17/02; H04R 1/342; G10K 11/1788; G10K 2200/10
See application file for complete search history.

(56) References Cited

U.S. PATENT DOCUMENTS

2004/0185804 A1* 9/2004 Kanamori ..... H04R 3/005 455/114.2
2005/0249355 A1* 11/2005 Chen ..... G10K 11/1784 381/71.14
2006/0018502 A1* 1/2006 Onuma ..... H04R 1/323 381/412
2008/0069372 A1* 3/2008 Zhang ..... H04R 3/005 381/92
2009/0196454 A1* 8/2009 Her ..... H04R 25/00 381/380
2011/0282659 A1* 11/2011 Lim ..... H04M 9/08 704/226
2013/0028451 A1* 1/2013 de Roo ..... H04R 1/38 381/312
2017/0229110 A1* 8/2017 Park ..... G10K 11/1788

* cited by examiner

*Primary Examiner* — Mohammad Islam
(74) *Attorney, Agent, or Firm* — JCIPRNET

(57) ABSTRACT

A microphone device including a first sound receiving module and a second sound receiving module is provided. The first sound receiving module includes a first output terminal and receives a sound signal to output a first electronic signal through the first output terminal. The second sound receiving module, which disposed adjacent to the first sound receiving module to receive the sound signal, includes a second output terminal and outputs a second electronic signal through the second output terminal accordingly. The first output terminal of the first sound receiving module is coupled to the second output terminal of the second sound receiving module, and the phase of the first electronic signal and the phase of the second electronic signal are inverse to each other.

16 Claims, 6 Drawing Sheets

MICROPHONE DEVICE

CROSS-REFERENCE TO RELATED APPLICATION

This application claims the priority benefit of Taiwan application serial no. 105134222, filed on Oct. 24, 2016. The entirety of the above-mentioned patent application is hereby incorporated by reference herein and made a part of this specification.

BACKGROUND OF THE INVENTION

Field of the Invention

The invention relates to a microphone device, more particularly relates to a microphone device capable of canceling far field noise.

Description of Related Art

Along with the continuous improvement of technology, all of electronic products have been developed with a tendency to become lighter and more miniaturized, and the electronic products like smartphone, tablet computer, or notebook, etc., have become indispensable in daily life of human beings. For each of those aforementioned electronic products, in order to allow a user/listener to listen to the audio information provided by the electronic product without disturbing the other people around, an earphone has become a necessary accessory to the electronic product. Otherwise, in order to make a phone call by using the electronic products, a headset having a microphone is also a popular accessory.

In order to perform both audio listening and sound collecting functions, a conventional headset adopts a design having an earphone and a microphone separated from each other, the earphone and the microphone are connected to each other via a signal wire or a simple structure. Therefore, the earphone is close to the ear, and the microphone is close to the mouth. However, the microphone in the above-mentioned design also receives the environmental noise, so the distinctness of the voice of the user is greatly affected. Generally speaking, the microphone has been improved both in sound-receiving efficiency and stability, and can provide clear and fluent voice quality either in a noisy environment or in high-speed movement. However, since a diaphragm for reception is a plane, phase noises are caused. That is to say, sound generated by a sounder and surrounding environmental noises may be heard by a receiver together, which interferes in the understanding of an audio message by the receiver.

SUMMARY OF THE INVENTION

Accordingly, the invention provides a microphone device capable of canceling far field environmental noise when receiving sound, so as to improve sound-receiving quality.

A microphone device provided in the invention includes a first sound receiving module and a second sound receiving module. The first sound receiving module has a first output terminal and receives an sound signal to output a first electronic signal through the first output terminal. The second sound receiving module, which has a second output terminal, is disposed adjacent to the first sound receiving module to receive the sound signal and to output a second electronic signal through the second output terminal accordingly. The first output terminal of the first sound receiving module is coupled to the second output terminal of the second sound receiving module, and the phase of the first electronic signal and the phase of the second electronic signal are inverse to each other.

In one embodiment of the invention, the first sound receiving module includes a first diaphragm and a first electrode plate, and the second sound receiving module includes a second diaphragm and a second electrode plate. The sound signal drives the first diaphragm and the second diaphragm to vibrate simultaneously.

In one embodiment of the invention, the first sound receiving module and the second sound receiving module are constituted by at least two bidirectional microphones, and a motion direction of the first diaphragm with respect to the first electrode plate and a motion direction of the second diaphragm with respect to the second electrode plate are opposite each other.

In one embodiment of the invention, the first sound receiving module has a first sound-receiving hole, and the second sound receiving module has a second sound-receiving hole. An opening direction of the first sound-receiving hole and an opening direction of the second sound-receiving hole are opposite directions.

In one embodiment of the invention, the first sound receiving module and the second sound receiving module are constituted by at least two omnidirectional microphones, and a motion direction of the first diaphragm with respect to the first electrode plate and an motion direction of the second diaphragm with respect to the second electrode plate are identical.

In one embodiment of the invention, the first sound receiving module has a first sound-receiving hole, and the second sound receiving module has a second sound-receiving hole. An opening direction of the first sound-receiving hole and an opening direction of the second sound-receiving hole are identical.

In one embodiment of the invention, the first sound receiving module further includes a first amplifier. An input terminal of the first amplifier is coupled with the first electrode plate to output the first electronic signal to the first output terminal in response to vibration of the first diaphragm. The second sound receiving module further includes a second amplifier, and an input terminal of the second amplifier is coupled with the second electrode plate to output the second electronic signal to the second output terminal in response to vibration of the second diaphragm.

In one embodiment of the invention, the first sound receiving module includes a first housing and the second sound receiving module further includes a second housing. The first diaphragm and the first electrode plate are disposed inside a first space formed by the first housing, and the second diaphragm and the second electrode plate are disposed inside a second space formed by the second housing.

In one embodiment of the invention, the first amplifier includes a non-inverting amplifier, and the second amplifier includes an inverting amplifier.

In one embodiment of the invention, the microphone device further includes an amplifier. An input terminal of the amplifier is coupled with the first output terminal and the second output terminal to receive the first electronic signal and the second electronic signal.

In one embodiment of the invention, the microphone device further includes a housing. The first sound receiving module and the second sound receiving module are disposed inside a space formed by the housing to receive the sound signal via the same sound-receiving hole.

In one embodiment of the invention, the first output terminal and the second output terminal are connected in a parallel manner to result in mutual cancellation of signals.

In one embodiment of the invention, the microphone device further includes a calibration circuit. The calibration circuit is coupled to the first sound receiving module and the second sound receiving module to receive the first electronic signal and the second electronic signal, so as to perform matching calibration for the first electronic signal and the second electronic signal.

Based on the above, in the embodiments of the invention, the microphone device includes two sound receiving modules. The output terminals of the two sound receiving modules are connected with each other in parallel to result in mutual cancellation of electronic signals caused by far field noise. As a result, the sound-receiving quality of the microphone device can be greatly improved.

In order to make the aforementioned and other features and advantages of the invention more comprehensible, embodiments accompanying figures are described in detail bellows.

DESCRIPTION OF THE EMBODIMENTS

Figure 1:
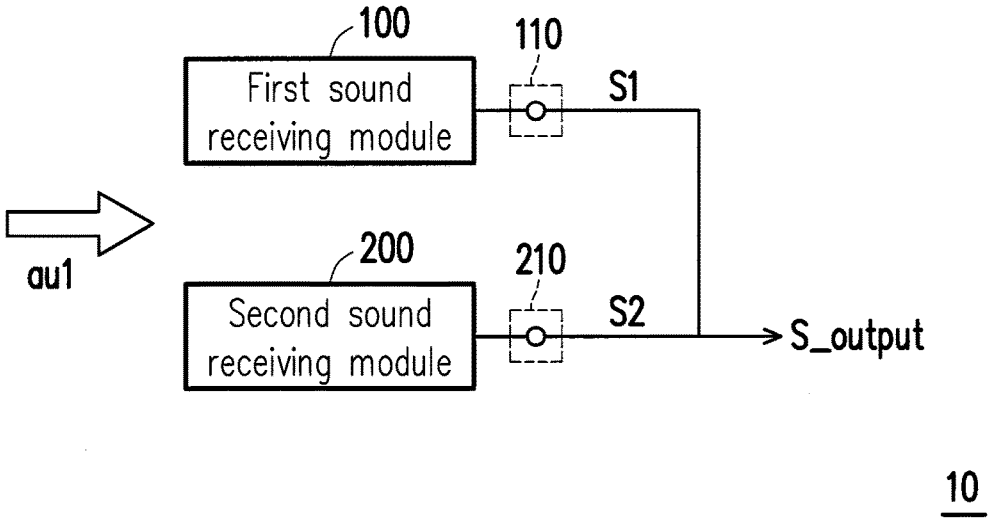
FIG. 1 is a schematic block diagram depicting a microphone device according to one embodiment of the invention.

FIG. 1 is a schematic block diagram depicting a microphone device according to one embodiment of the invention. Referring to FIG. 1, a microphone device 10 is configured to capture a sound signal au1 from outside and convert the sound signal au1 to an electronic audio signal. In the present embodiment, the microphone device 10 includes a first sound receiving module 100 and a second sound receiving module 200. The first sound receiving module 100 receives the sound signal au1, and the second sound receiving module 200 is disposed adjacent to the first sound receiving module 100 to simultaneously receive the sound signal au1. Take the condenser microphone as an example, the first sound receiving module 100 includes a first diaphragm, and the second sound receiving module 200 includes a second diaphragm. The sound signal au1 can drive the first diaphragm and the second diaphragm to vibrate simultaneously. The first sound receiving module 100 has a first output terminal 110 and receives the sound signal au1 to output a first electronic signal S1 through the first output terminal 110. The second sound receiving module 200 has a second output terminal 210 and outputs a second electronic signal S2 through the second output terminal 210 accordingly. It should be noted here, the first electronic signal S1 and the second electronic signal S2 are electronic audio signals caused by far field noise components contained in the sound signal au1, and the far field noise components are the background noises of the sound signal au1, for example.

Figure 2:
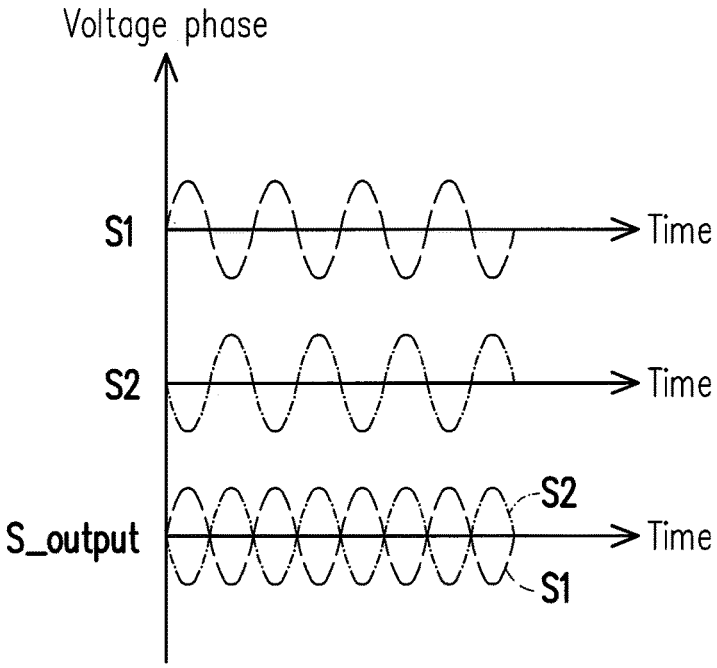
FIG. 2 is a schematic diagram depicting exemplary voltage phases of electronic signals according to one embodiment of the invention.

In the present embodiment, the first output terminal 110 of the first sound receiving module 100 is coupled to the second output terminal 210 of the second sound receiving module 200, and the phase of the first electronic signal S1 and the phase of the second electronic signal S2 are inverse to each other. Based on this, the first output terminal 110 and the second output terminal 210 are connected in a parallel manner to result in mutual cancellation of the first electronic signal S1 and the second electronic signal S2. To be more specific, FIG. 2 is a schematic diagram depicting exemplary voltage phases of electronic signals according to one embodiment of the invention. Referring to FIG. 2, the voltage phase of the first electronic signal S1 and the voltage phase of the second electronic signal S2 are inverse to each other. Since the first output terminal 110 and the second output terminal 210 are connected to each other in parallel, the first electronic signal S1 and the second electronic signal S2 cancel each other out to keep an output signal S_output at a specific voltage phase (such as 0 volt). Therefore, the microphone device of the invention can filter the far field noise out in sound-receiving process in order to improve sound-receiving quality of the microphone device.

Figure 3:
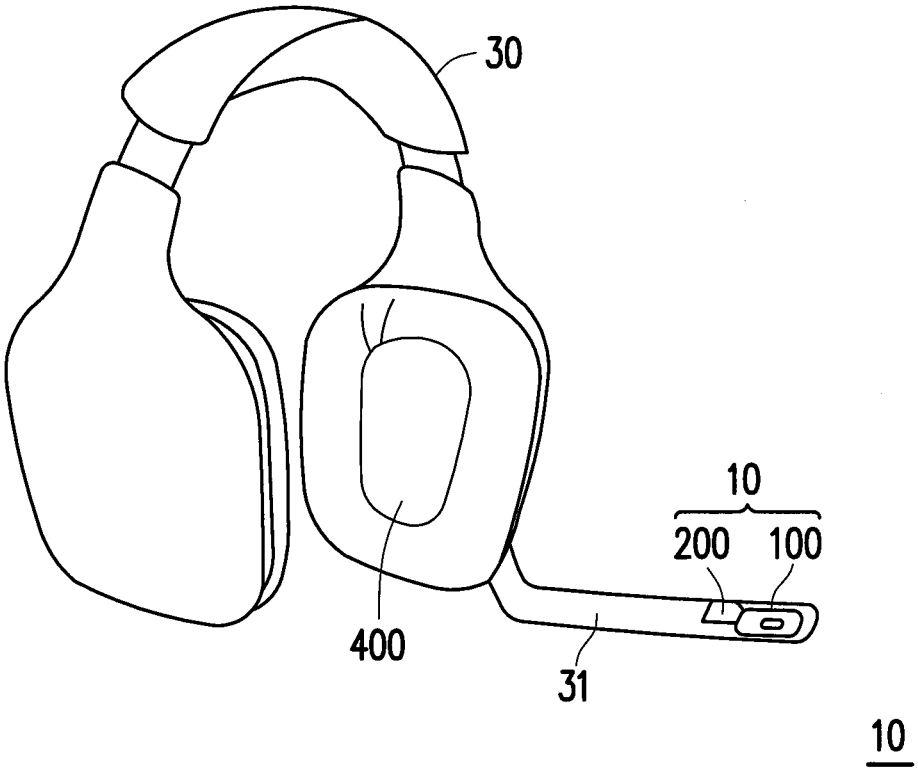
FIG. 3 is a schematic view depicting application of a microphone device according to one embodiment of the invention.

FIG. 3 is a schematic view depicting application of a microphone device according to one embodiment of the invention. Referring to FIG. 1 to FIG. 3, an earphone microphone 30 may include the microphone device 10 and an earphone 400. Earmuffs of the earphone 400 are designed to cover the ears of the user, the microphone device 10 is disposed at an end of an extending structure 31 so that the microphone device 10 can be close to the mouth of the user. In other words, the first sound receiving module 100 and the second sound receiving module 200 of the microphone device 10 are disposed adjacent to each other on the extending structure 31. The microphone device 10 is structurally or electrically designed so that the phases of the first electronic signal S1 and the second electronic signal S2 are inverse to each other. Hence, through connecting the output terminal of the first sound receiving module 100 and the output terminal of the second sound receiving module 200 in parallel, the earphone microphone 30 can filter out the background noise, which is the far field component, so as to improve the sound receiving effect to make the human voice more clear. Although FIG. 3 depicts an exemplary application that the microphone device 10 is disposed on the earphone microphone, the invention is not limited thereto. For example, the microphone device of the invention may be provided in a headset microphone or a speakerphone microphone.

Figure 4A:
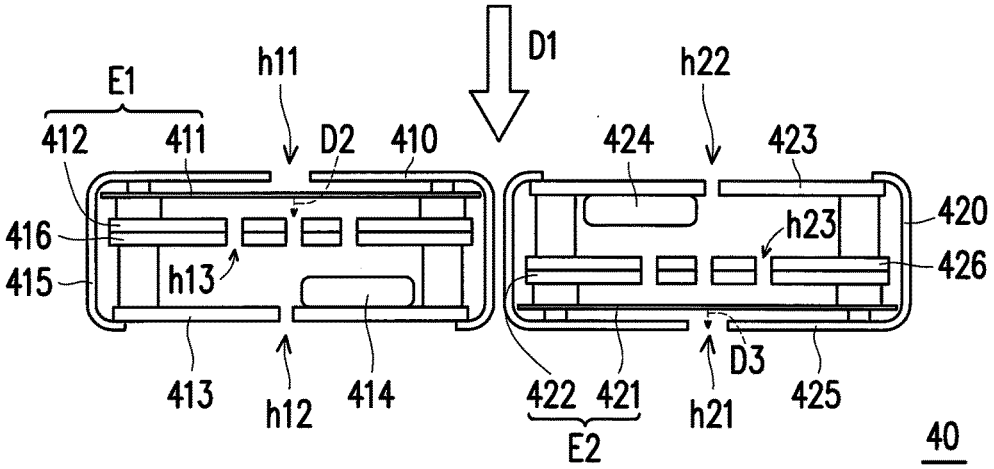
FIG. 4A is a cross-sectional schematic view depicting a microphone device according to one embodiment of the invention.
Figure 4B:
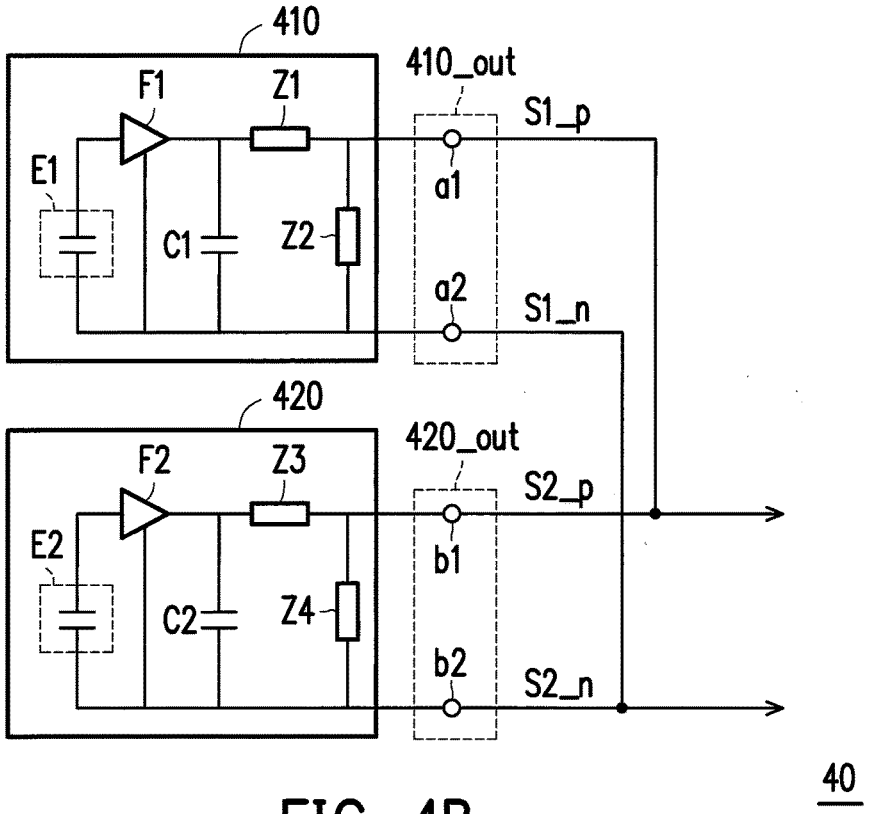
FIG. 4B is a schematic view depicting an electric circuit of a microphone device according to one embodiment of the invention.

Several exemplary embodiments are described below to illustrate the invention in detail. FIG. 4A is a cross-sectional schematic view depicting a microphone device according to one embodiment of the invention. FIG. 4B is a schematic view depicting an electric circuit of a microphone device according to one embodiment of the invention. Referring to FIG. 4A, in the present embodiment, a first sound receiving module 410 and a second sound receiving module 420 are constituted by at least two bidirectional microphones, for example. A microphone device 40 includes the first sound receiving module 410 and the second sound receiving module 420 disposed adjacent to one another, and the first sound receiving module 410 and the second sound receiving module 420 together receive a sound signal transmitted along a sound pressure direction D1. The first sound receiving module 410 includes a first diaphragm 411, a first electrode plate 412, a substrate 413, an audio processing integrated circuit 414, a first housing 415, and a supporting plate 416. The second sound receiving module 420 includes a second diaphragm 421, a second electrode plate 422, a substrate 423, an audio processing integrated circuit 424, a first housing 425, and a supporting plate 426.

To be more specific, a first space formed by the first housing 415 and the substrate 413 and a second space formed by the second housing 425 and the substrate 423 are separated from and independent of each other. The first diaphragm 411, the first electrode plate 412, the audio processing integrated circuit 414, and the supporting plate 416 are disposed inside the first space formed by the first housing 415 and the substrate 413, and the second diaphragm 421, the second electrode plate 422, the audio processing integrated circuit 424, and the supporting plate 426 are disposed inside the second space formed by the second housing 425 and the substrate 423.

In the present embodiment, the first diaphragm 411 and the first electrode plate 412 forms two electrodes of a microphone unit E1. The substrate 413 may be a printed circuit board (PCB) on which the audio processing integrated circuit 414 is disposed, and the substrate 413 has a bottom pore h12. The supporting plate 416 is configured to support the first electrode plate 412, and the supporting plate 416 and the first electrode plate 412 have a plurality of pores (such as pore h13).

The first sound receiving module 410 has a first sound-receiving hole h11, the sound signal presses along the sound pressure direction D1 and toward the first diaphragm 411 through the first sound-receiving hole h11. When the first diaphragm 411 starts receiving the sound wave from the sound signal, the first diaphragm 411 starts vibrating to result in changes in capacitance value, which leads to changes in the output voltage of the microphone unit E1.

In the present embodiment, the structure and the operating principle of the second sound receiving module 420 are the same as that of the first sound receiving module 410 and will not be repeated hereinafter. It should be noted here, compared to the first sound receiving module 410, the second sound receiving module 420 is placed in an upside down manner. In other words, an opening direction of the first sound-receiving hole h11 and an opening direction of the second sound-receiving hole h21 are opposite directions. As a result, when the first sound receiving module 410 receives sound through the first sound-receiving hole h11 at the top of the first sound receiving module 410, the second sound receiving module 420 receives sound through a pore h22 at the bottom of the second sound receiving module 420. Specifically, the sound signal presses along the sound pressure direction D1 and towards the second diaphragm 421 through the pore h22 and the pore h23. When the second diaphragm 421 starts receiving the sound wave from the sound signal, the second diaphragm 421 starts vibrating to result in changes in capacitance value, which leads to changes in the output voltage of the microphone unit E2. Overall, when the first sound receiving module 410 and the second sound receiving module 420 together receive the sound signal transmitted along the sound pressure direction D1, a motion direction D2 of the first diaphragm 411 with respect to the first electrode plate 412 and a motion direction D3 of the second diaphragm 421 with respect to the second electrode plate 422 are opposite each other.

Next, referring to FIG. 4B, the first sound receiving module 410 further includes a first amplifier F1, a capacitor C1, and impedance components Z1 to Z2. An input terminal of the first amplifier F1 is coupled with the first electrode plate 412 of the microphone unit E1 to output the first electronic signal to the first output terminal 410_out in response to vibration of the first diaphragm 411. In view of this, the first output terminal 410_out includes a output terminal a1 and a ground terminal a2, and the first electronic signal outputted from the first sound receiving module 410 includes a first output signal S1_p and a first ground signal S1_n.

Similarly, the second sound receiving module 420 further includes a second amplifier F2, a capacitor C2, and impedance components Z3 to Z4. An input terminal of the second amplifier F2 is coupled with the second electrode plate 422 of the microphone unit E2 to output the second electronic signal to the second output terminal 420_out in response to vibration of the second diaphragm 421. In view of this, the second output terminal 420_out includes a output terminal b1 and a ground terminal b2, and the second electronic signal outputted from the second sound receiving module 420 includes a second output signal S2_p and a second ground signal S2_n.

The first output terminal 410_out is coupled with the second output terminal 420_out. To be more specific, the output terminal al of the first output terminal 410_out is coupled to the output terminal b1 of the second output terminal 420_out, and the ground terminal a2 of the first output terminal 410_out is coupled to the ground terminal b2 of the second output terminal 420_out. Under the circumstance that the first output terminal 410_out is connected with the second output terminal 420_out in parallel, since the motion direction D2 of the first diaphragm 411 in the microphone unit E1 with respect to the first electrode plate 412 and the motion direction D3 of the second diaphragm 421 in the microphone unit E2 with respect to the second electrode plate 422 are opposite each other, the first output signal S1_p and the second output signal S2_p caused by far field noise components contained in the sound signal can cancel each other out. As a result, the microphone device 40 can filter the signal component caused by far field noise out, so as to improve sound-receiving quality.

Figure 5:
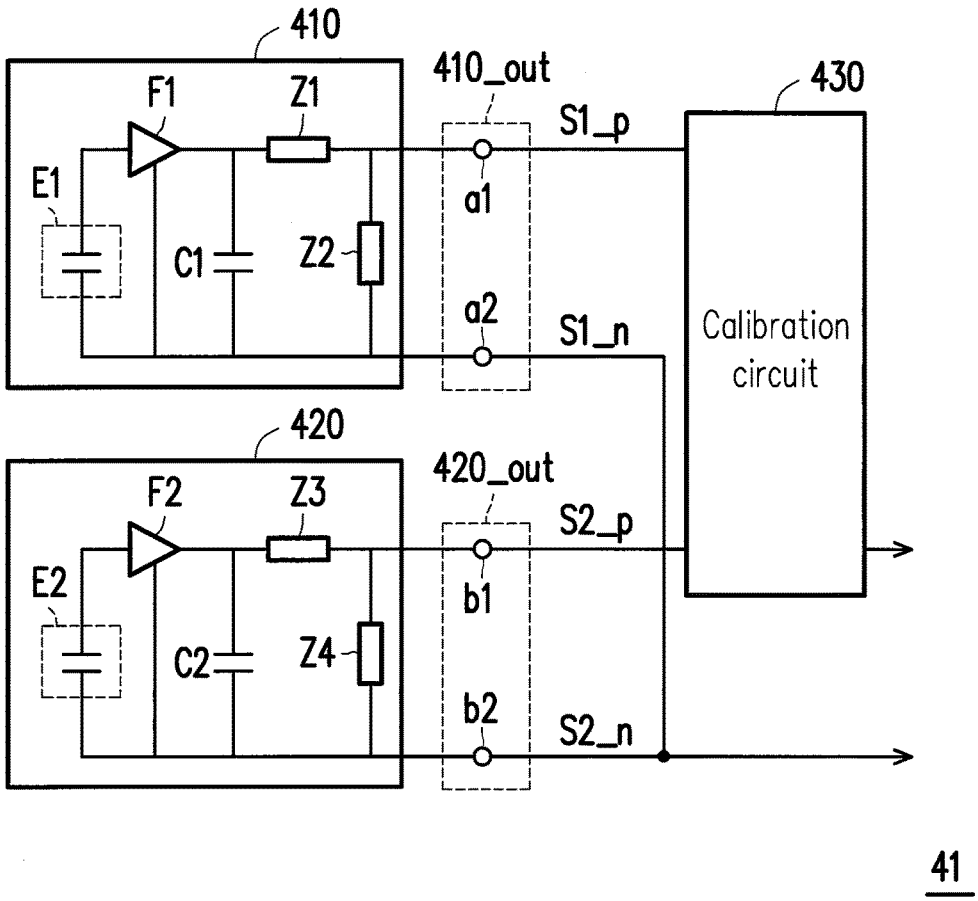
FIG. 5 is a schematic view depicting an electric circuit of a microphone device according to one embodiment of the invention.

FIG. 5 is a schematic view depicting an electric circuit of a microphone device according to one embodiment of the invention. Referring to FIG. 5, similarly, the microphone device 41 in the present embodiment includes the first sound receiving module 410 and the second sound receiving module 420. The first output terminal 410_out of the first sound receiving module 410 and the second output terminal 420_out of the second sound receiving module 420 are connected with each other in parallel. Compared to the microphone device 40 in the aforementioned embodiment, the microphone device 41 in present embodiment further includes a calibration circuit 430. The calibration circuit 430 is coupled to the first sound receiving module 410 and the second sound receiving module 420 to receive the first electronic signal outputted from the first sound receiving module 410 and the second electronic signal outputted from the second sound receiving module 420. The calibration circuit 430 performs matching calibration for the first electronic signal and the second electronic signal, so as to guarantee that the first electronic signal and the second electronic signal caused by far field noise components contained in the sound signal can completely cancel each other out. In the embodiment of FIG. 5, the calibration circuit 430 is coupled between the output terminal al of the first output terminal 410_out and the output terminal b1 of the second output terminal 420_out, and the calibration circuit 430 is a RC circuit composed of resistors and capacitors, for example, the invention is not limited thereto. However, the structure of the two bidirectional microphones illustrated in FIG. 4A is an example for clearly describing the concept of the invention, but the invention is not limited thereto. For example, in the other embodiment, the electrode plates of the two bidirectional microphones may be affixed on a printed circuit board.

Figure 6A:
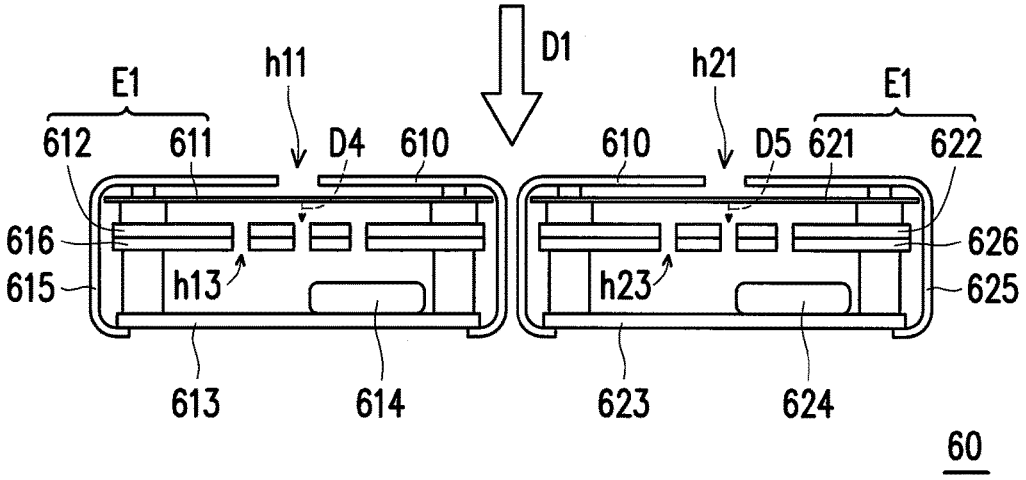
FIG. 6A is a cross-sectional schematic view depicting a microphone device according to one embodiment of the invention.
Figure 6B:
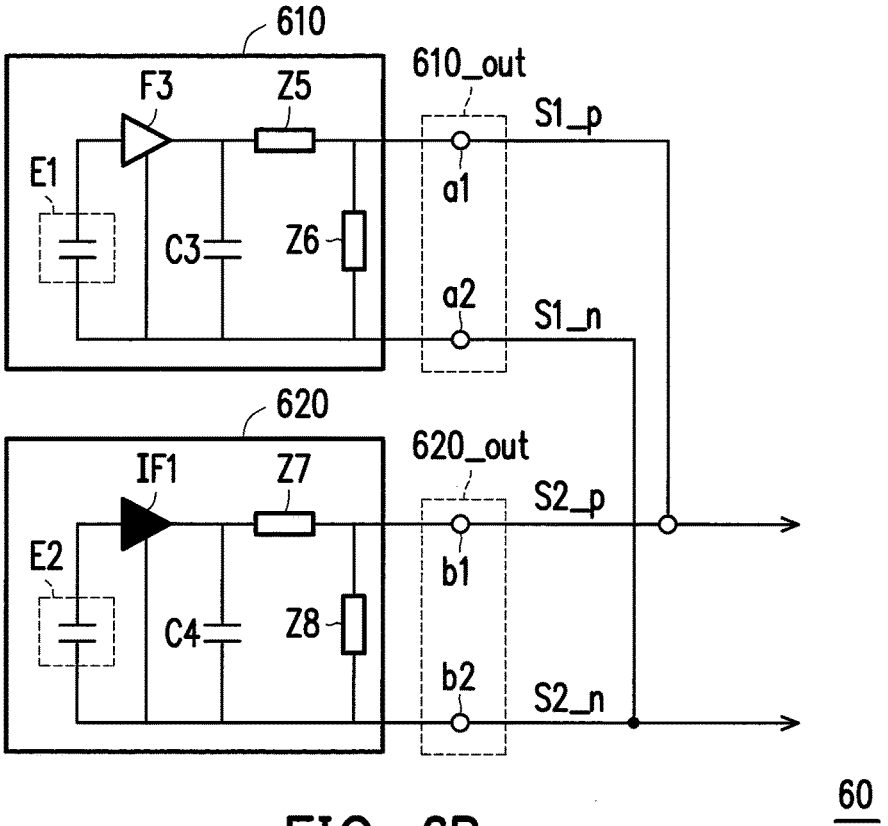
FIG. 6B is a schematic view depicting an electric circuit of a microphone device according to one embodiment of the invention.

FIG. 6A is a cross-sectional schematic view depicting a microphone device according to one embodiment of the invention. FIG. 6B is a schematic view depicting an electric circuit of a microphone device according to one embodiment of the invention. Referring to FIG. 6A, in the present embodiment, a first sound receiving module 610 and a second sound receiving module 620 are constituted by at least two omnidirectional microphones, for example. A microphone device 60 includes the first sound receiving module 610 and the second sound receiving module 620 disposed adjacent to one another, and the first sound receiving module 610 and the second sound receiving module 620 together receive a sound signal transmitted along a sound pressure direction D1. The first sound receiving module 610 includes a first diaphragm 611, a first electrode plate 612, a substrate 613, an audio processing integrated circuit 614, a first housing 615, and a supporting plate 616. The second sound receiving module 620 includes a second diaphragm 621, a second electrode plate 622, a substrate 623, an audio processing integrated circuit 624, a first housing 625, and a supporting plate 626.

To be more specific, a first space formed by the first housing 615 and the substrate 613 and a second space formed by the second housing 625 and the substrate 623 are separated from and independent of each other. The first diaphragm 611, the first electrode plate 612, the audio processing integrated circuit 614, and the supporting plate 616 are disposed inside the first space formed by the first housing 615 and the substrate 613, and the second diaphragm 621, the second electrode plate 622, the audio processing integrated circuit 624, and the supporting plate 626 are disposed inside the second space formed by the second housing 625 and the substrate 623.

In the present embodiment, the structure and the operating principle of the first sound receiving module 610 are the same as that of the first sound receiving module 410 shown in FIG. 4A and will not be repeated hereinafter. The structure and the operating principle of the second sound receiving module 620 are the same as that of the first sound receiving module 410 shown in FIG. 4A and will not be repeated hereinafter.

It should be noted here, the differences between the present embodiment and the embodiment in FIG. 4 are that the first sound receiving module 610 and the second sound receiving module 620 are placed in order to orient the sound-receiving holes toward the same direction. In other words, an opening direction of a first sound-receiving hole h11 of the first sound receiving module 610 and an opening direction of a second sound-receiving hole h21 of the second sound receiving module 620 are the same direction. As a result, when the first sound receiving module 610 receives sound through the first sound-receiving hole h11 at the top of the first sound receiving module 610, similarly, the second sound receiving module 620 also receives sound through the second sound-receiving hole h21 at the top of the second sound receiving module 620. Specifically, the sound signal presses along the sound pressure direction D1, through the first sound-receiving hole h11 and the second sound-receiving hole h21, and towards the first diaphragm 611 the second diaphragm 621. Overall, when the first sound receiving module 410 and the second sound receiving module 420 together receive the sound signal transmitted along the sound pressure direction D1, the sound signal drives the first diaphragm 611 and the second diaphragm 621 to vibrate simultaneously, and an motion direction D4 of the first diaphragm 611 with respect to the first electrode plate 612 and an motion direction D5 of the second diaphragm 621 with respect to the second electrode plate 622 are the same.

Next, referring to FIG. 6B, the first sound receiving module 610 further includes a first amplifier F3, a capacitor C3, and impedance components Z5 to Z6. An input terminal of the first amplifier F3 is coupled with the first electrode plate 612 of the microphone unit E1 to output the first electronic signal to the first output terminal 610_out in response to vibration of the first diaphragm 611. In view of this, the first output terminal 610_out includes a output terminal al and a ground terminal a2, and the first electronic signal outputted from the first sound receiving module 610 includes a first output signal S1_p and a first ground signal S1_n. Similarly, the second sound receiving module 620 further includes a second amplifier IF1, a capacitor C4, and impedance components Z7 to Z8. An input terminal of the second amplifier IF1 is coupled with the second electrode plate 622 of the microphone unit E2 to output the second electronic signal to the second output terminal 620_out in response to vibration of the second diaphragm 621. In view of this, the second output terminal 620_out includes a output terminal b1 and a ground terminal b2, and the second electronic signal outputted from the second sound receiving module 620 includes a second output signal S2_p and a second ground signal S2_n that are inverse to each other.

It should be noted here, in the present embodiment, the first amplifier F3 includes a non-inverting amplifier, and the second amplifier IF1 includes an inverting amplifier. Although the motion direction D4 of the first diaphragm 611 in the microphone unit E1 with respect to the first electrode plate 612 and the motion direction D5 of the second diaphragm 621 in the microphone unit E2 with respect to the second electrode plate 622 are the same, the second amplifier IF1 can reverse the phase of the second electronic signal generated by the microphone unit E2. Therefore, under the circumstance that the first output terminal 610_out is connected with the second output terminal 620_out in parallel, the first output signal S1_p and the second output signal S2_p caused by far field noise components contained in the sound signal can cancel each other out. As a result, the microphone device 60 can filter the signal component caused by far field noise out, so as to improve sound-receiving quality. However, the structure of the two omnidirectional microphones illustrated in FIG. 6A is an example for clearly describing the concept of the invention, but the invention is not limited thereto. For example, in the other embodiment, the electrode plates of the two omnidirectional microphones may be configured by the other ways.

Figure 7A:
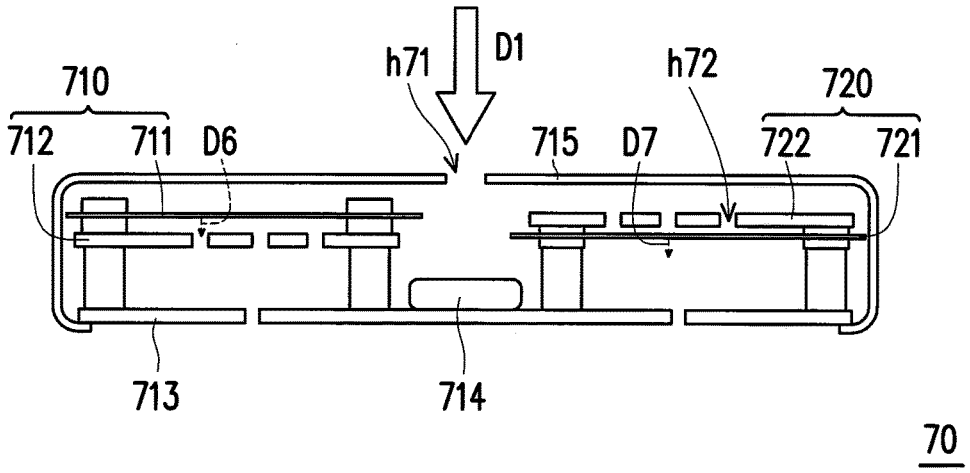
FIG. 7A is a cross-sectional schematic view depicting a microphone device according to one embodiment of the invention.
Figure 7B:
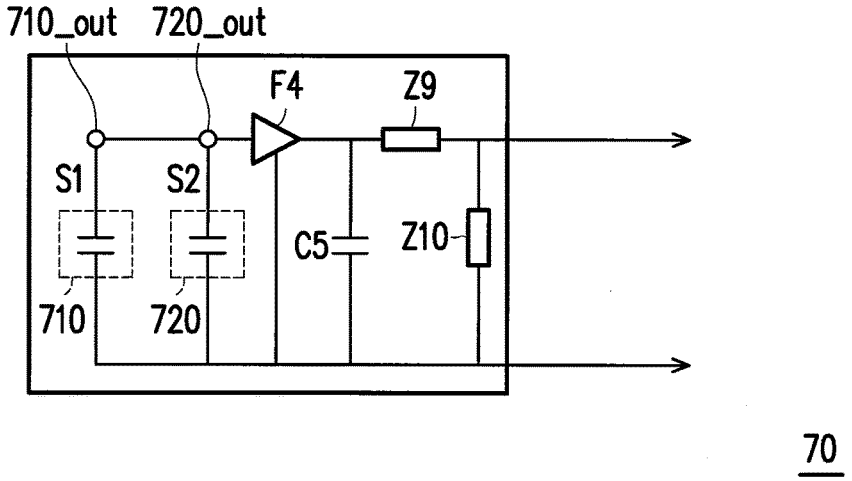
FIG. 7B is a schematic view depicting an electric circuit of a microphone device according to one embodiment of the invention.

FIG. 7A is a cross-sectional schematic view depicting a microphone device according to one embodiment of the invention. FIG. 7B is a schematic view depicting an electric circuit of a microphone device according to one embodiment of the invention. Referring to FIG. 7A, the microphone device 70 may include a first sound receiving module 710, a second sound receiving module 720, a substrate 713, an audio processing integrated circuit 714, and a housing 715. The first sound receiving module 710 includes a first diaphragm 711 and a first electrode plate 712, and the second sound receiving module 720 includes a second diaphragm 721 and a second electrode plate 722. The sound signal transmitted along the sound pressure direction D1 drives the first diaphragm 711 and the second diaphragm 721 to vibrate simultaneously. The materials of the first diaphragm 711 and the second diaphragm 721 are conductive materials, and the first electrode plate 712 and the second electrode plate 722 may be made of electret material, the invention is not limited thereto. In another embodiment, the first diaphragm 711 and the second diaphragm 721 may be made of electret material, and the materials of the first electrode plate 712 and the second electrode plate 722 may be conductive materials. The first electrode plate 712 and the second electrode plate 722 have a plurality of pores (such as pore h72).

It should be noted here, in the present embodiment, each of the first sound receiving module 710 and the second sound receiving module 720 is a microphone unit constituted by a diaphragm and an electrode plate. The first sound receiving module 710 and the second sound receiving module 720 are disposed inside a space formed by the housing 715 and the substrate 714 to receive the sound signal from outside via the same sound-receiving hole h71. Moreover, the first diaphragm 711 is disposed above the first electrode plate 712, and the second diaphragm 721 is disposed under the second electrode plate 722. In other words, when the sound signal presses through the sound-receiving hole h71 towards the first diaphragm 711 and the second diaphragm 721, the first diaphragm 711 moves in a direction D6 to be close to the first electrode plate 712, but the second diaphragm 721 moves in a direction D7 to be far away from the second electrode plate 722. Moreover, the motion direction of the first diaphragm 711 with respect to the first electrode plate 712 and the motion direction of the second diaphragm 721 with respect to the second electrode plate 722 are opposite each other.

Referring to FIG. 7B again, the first output terminal 710_out of the first sound receiving module 710 is coupled to the second output terminal 720_out of the second sound receiving module 720. In other words, the first sound receiving module 710 and the second sound receiving module 720 are connected in parallel with each other. The microphone device 70 further includes an amplifier F4, a capacitor C5, and impedance components Z9 to Z10. An input terminal of the amplifier F4 is coupled with the first output terminal 710_out and the second output terminal 720_out to receive the first electronic signal S1 and the second electronic signal S2. Under the circumstance that the first output terminal 710_out of the first sound receiving module 710 is connected in parallel with the second output terminal 720_out of the second sound receiving module 720, since the motion direction of the first diaphragm 711 with respect to the first electrode plate 712 and the motion direction of the second diaphragm 721 with respect to the second electrode plate 722 are opposite each other, the first electronic signal S1 and the second electronic signal S2 caused by far field noise components contained in the sound signal can cancel each other out (as shown in FIG. 2). As a result, the microphone device 70 can filter the signal component caused by far field noise out, so as to improve sound-receiving quality. However, the structure of the microphone illustrated in FIG. 7A is an example for clearly describing the concept of the invention, but the invention is not limited thereto.

To sum up, in the embodiments of the invention, because of the positions of the first diaphragm, the second diaphragm with respect to the first electrode plate and the second electrode plate, the motion direction of the first diaphragm with respect to the first electrode plate and the motion direction of the second diaphragm with respect to the second electrode plate are opposite directions, so as to result in mutual cancellation of the first electronic signal and the second electronic signal. Otherwise, since the amplifier in one of the two sound receiving modules is an inverting amplifier, the two sound receiving modules can output the first electronic signal and the second electronic signal that are inverse to each other. Because the first electronic signal and the second electronic signal caused by far field noise components contained in the sound signal are inverse to each other, the first electronic signal and the second electronic signal can cancel each other out by connecting the first sound receiving module, which includes the first diaphragm and the first electrode plate, to the second sound receiving module, which includes the second diaphragm and the second electrode plate, in parallel. As a result, the interference of the environmental noise on the microphone device is greatly reduced, so as to improve sound receiving efficiency of the microphone device.

Although the invention has been disclosed with reference to the aforesaid embodiments, they are not intended to limit the invention. It will be apparent to one of ordinary skill in the art that modifications and variations to the described embodiments may be made without departing from the spirit and the scope of the invention. Accordingly, the scope of the invention will be defined by the attached claims and not by the above detailed descriptions.

What is claimed is:

1. A microphone device, comprising:

a first sound receiving module, comprising a first diaphragm and a first electrode plate, having a first output terminal, and receiving a sound signal to output a first electronic signal through the first output terminal; and a second sound receiving module, comprising a second diaphragm and a second electrode plate, having a second output terminal, disposed adjacent to the first sound receiving module to receive the sound signal and to output a second electronic signal through the second output terminal accordingly, wherein the first output terminal of the first sound receiving module is coupled to the second output terminal of the second sound receiving module, and a phase of the first electronic signal and a phase of the second electronic signal are inverse to each other according as a motion direction of the first diaphragm with respect to the first electrode plate and a motion direction of the second diaphragm with respect to the second electrode plate are opposite each other, wherein the first output terminal and the second output terminal are connected in a parallel manner to result in mutual cancellation of signals.

2. The microphone device as recited in claim 1, wherein the sound signal drives the first diaphragm and the second diaphragm to vibrate simultaneously.

3. The microphone device as recited in claim 2, wherein the first sound receiving module and the second sound receiving module are constituted by at least two bidirectional microphones.

4. The microphone device as recited in claim 3, wherein the first sound receiving module has a first sound-receiving hole, the second sound receiving module has a second sound-receiving hole, and wherein an opening direction of the first sound-receiving hole and an opening direction of the second sound-receiving hole are opposite directions.

5. The microphone device as recited in claim 2, wherein the first sound receiving module further comprises a first amplifier, and an input terminal of the first amplifier is coupled with the first electrode plate to output the first electronic signal to the first output terminal in response to vibration of the first diaphragm, and wherein the second sound receiving module further comprises a second amplifier, and an input terminal of the second amplifier is coupled with the second electrode plate to output the second electronic signal to the second output terminal in response to vibration of the second diaphragm.

6. The microphone device as recited in claim 5, wherein the first sound receiving module comprises a first housing and the second sound receiving module further comprises a second housing, the first diaphragm and the first electrode plate are disposed inside a first space formed by the first housing, and the second diaphragm and the second electrode plate are disposed inside a second space formed by the second housing.

7. The microphone device as recited in claim 2, wherein the microphone device further comprises an amplifier, an input terminal of the amplifier is coupled with the first output terminal and the second output terminal to receive the first electronic signal and the second electronic signal.

8. The microphone device as recited in claim 7, wherein the microphone device further comprises a housing, the first sound receiving module and the second sound receiving module are disposed inside a space formed by the housing to receive the sound signal via a same sound-receiving hole.

9. The microphone device as recited in claim 1, wherein the microphone device further comprises a calibration circuit, the calibration circuit is coupled to the first sound receiving module and the second sound receiving module to receive the first electronic signal and the second electronic signal, so as to perform matching calibration for the first electronic signal and the second electronic signal.

10. A microphone device, comprising:

a first sound receiving module, having a first output terminal, and receiving a sound signal to output a first electronic signal through the first output terminal; and a second sound receiving module, having a second output terminal, disposed adjacent to the first sound receiving module to receive the sound signal and to output a second electronic signal through the second output terminal accordingly, wherein the first output terminal of the first sound receiving module is coupled to the second output terminal of the second sound receiving module, and a phase of the first electronic signal and a phase of the second electronic signal are inverse to each other according as a non-inverting amplifier and an inverting amplifier are respectively disposed in the first sound receiving module and the second sound receiving module, wherein the first output terminal and the second output terminal are connected in a parallel manner to result in mutual cancellation of signals.

11. The microphone device as recited in claim 10, wherein the first sound receiving module comprises a first diaphragm and a first electrode plate, the second sound receiving module comprises a second diaphragm and a second electrode plate, and the sound signal drives the first diaphragm and the second diaphragm to vibrate simultaneously.

12. The microphone device as recited in claim 11, wherein the first sound receiving module and the second sound receiving module are constituted by at least two omnidirectional microphones, and a motion direction of the first diaphragm with respect to the first electrode plate and a motion direction of the second diaphragm with respect to the second electrode plate are identical.

13. The microphone device as recited in claim 12, wherein the first sound receiving module has a first sound-receiving hole, the second sound receiving module has a second sound-receiving hole, and wherein an opening direction of the first sound-receiving hole and an opening direction of the second sound-receiving hole are identical.

14. The microphone device as recited in claim 11, wherein the first sound receiving module further comprises a first amplifier, and an input terminal of the first amplifier is coupled with the first electrode plate to output the first electronic signal to the first output terminal in response to vibration of the first diaphragm, and wherein the second sound receiving module further comprises a second amplifier, and an input terminal of the second amplifier is coupled with the second electrode plate to output the second electronic signal to the second output terminal in response to vibration of the second diaphragm.

15. The microphone device as recited in claim 14, wherein the first sound receiving module comprises a first housing and the second sound receiving module further comprises a second housing, the first diaphragm and the first electrode plate are disposed inside a first space formed by the first housing, and the second diaphragm and the second electrode plate are disposed inside a second space formed by the second housing.

16. The microphone device as recited in claim 14, wherein the first amplifier comprises the non-inverting amplifier, and the second amplifier comprises the inverting amplifier.

* * * * *